US008701449B2

(12) United States Patent
Back et al.

(10) Patent No.: US 8,701,449 B2
(45) Date of Patent: Apr. 22, 2014

(54) WATER LEVEL/VIBRATION SENSING APPARATUS FOR WASHING MACHINE AND WASHING MACHINE HAVING THE SAME

(75) Inventors: Dong Il Back, Suwon-si (KR); Weon Jin Song, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 981 days.

(21) Appl. No.: 12/654,199

(22) Filed: Dec. 14, 2009

(65) Prior Publication Data

US 2010/0170301 A1 Jul. 8, 2010

(30) Foreign Application Priority Data

Jan. 7, 2009 (KR) ..... 10-2009-0001236

(51) Int. Cl.
*D06F 35/00* (2006.01)

(52) U.S. Cl.
USPC ..... 68/12.05; 68/23.1; 73/722

(58) Field of Classification Search
USPC ..... 68/23.1, 12.05, 12.19–12.21; 73/722, 73/652
IPC ..... G01L 9/10
See application file for complete search history.

(56) References Cited

U.S. PATENT DOCUMENTS 5,408,457 A * 4/1995 Fujino et al. ..... 367/178
6,292,966 B1 * 9/2001 Lim et al. ..... 8/158

FOREIGN PATENT DOCUMENTS

JP 2000245990 A * 9/2000
JP 2002336595 A * 11/2002
JP 2002355488 A * 12/2002
KR 2000-0014063 3/2000
KR 2000014063 A * 3/2000
KR 2009021760 A * 3/2009

OTHER PUBLICATIONS

Machine translation of Inoue (JP2002336595).*

* cited by examiner

*Primary Examiner* — Michael Barr
*Assistant Examiner* — Kevin G Lee
(74) *Attorney, Agent, or Firm* — Staas & Halsey LLP

(57) ABSTRACT

Disclosed herein are a water level/vibration sensing apparatus and a washing machine having the same. The water level/vibration sensing apparatus includes a housing provided with a pressure chamber communicating with an air inlet, a diaphragm unit moving forward and backward according to the variation of a pressure in the pressure chamber, a core and a coil forming a frequency varied according to the forward and backward movement of the diaphragm unit, and a collision member striking the diaphragm unit according to the movement of the housing. Therefore, the water level/vibration sensing apparatus simultaneously senses the washing water level and the vibration of the washing machine.

36 Claims, 6 Drawing Sheets

WATER LEVEL/VIBRATION SENSING APPARATUS FOR WASHING MACHINE AND WASHING MACHINE HAVING THE SAME

BACKGROUND

1. Field

Embodiments of the present invention relate to a water level/vibration sensing apparatus for washing machines, which is suitable to simultaneously sense vibration and water level of a washing machine, and a washing machine having the same.

2. Description of the Related Art

In general, a washing machine is an apparatus, which forms a water current by rotating a pulsator using the driving force of a motor, and washes laundry by causing the water current to apply an impact to the laundry.

The operation of the washing machine is generally carried out in the order of washing, rinsing, and dehydrating courses.

In the washing course, laundry is washed by friction between the laundry and a water current generated by rotating the pulsator under the condition that washing water and a detergent are supplied to the inside of a tub.

In the rinsing course, after the washing course has been competed, the washing water in the tub is drained, new water is supplied to the inside of the tub, and then a spin basket is rotated several times. The rinsing course is repeated several times in this way, and the washing water in the tub is finally drained.

In the dehydrating course, the remaining washing water in the laundry is removed by rotating the tub at a high speed.

A water level sensing apparatus, which senses a water level in the tub such that a proper amount of the washing water is supplied to the inside of the tub according to the amount of the laundry in the tub during the water supplying and rinsing courses, is installed in the washing machine.

Further, a vibration sensing apparatus, which senses unbalance generated by the eccentric rotation of the spin basket due to the partial disposition of the laundry during the dehydrating course, is installed in the washing machine.

Recently, in order to reduce a cost increase due to the separate installation of the water level sensing apparatus to sense the water level of the washing machine and the vibration sensing apparatus to sense the vibration of the washing machine, a study into a single sensing apparatus, which simultaneously senses the water level and vibration of a washing machine, is underway.

SUMMARY

Therefore, it is an aspect of the present invention to provide a water level/vibration sensing apparatus for washing machines, which has a simple structure and is suitable to simultaneously sense the vibration and water level of a washing machine precisely, and a washing machine having the same.

It is another aspect of the present invention to provide a water level/sensing apparatus for washing machines, which senses various types of the vibration of a washing machine, and a washing machine having the same.

Additional aspects of the invention will be set forth in part in the description which follows and, in part, will be obvious from the description, or may be learned by practice of the invention.

In accordance with one aspect of the present invention, a water level/vibration sensing apparatus includes a housing provided with a pressure chamber communicating with an air inlet, a diaphragm unit moving forward and backward according to the variation of a pressure in the pressure chamber, and a core and a coil forming a frequency varied according to the forward and backward movement of the diaphragm unit, wherein a collision member striking the diaphragm unit according to the movement of the housing is provided.

A reception part, one end of which is opened to receive the collision member, may be formed in the pressure chamber.

The reception part may have a cylindrical shape.

A restricting protrusion may be formed at a designated region side of the inner wall of the reception part.

The restricting protrusion may include a restriction part to restrict the movement of the collision member, and a tilt part to facilitate the return of the collision member to an original position thereof after the movement of the collision member.

The inner wall of the reception part may be tilted at a designated angle.

A tilt plane may be formed on the reception part.

The air inlet may be formed within the reception part.

A rib to prevent the air inlet from being closed with the collision member may be provided around the air inlet.

The collision member may be made of a rustproof metal.

In accordance with another aspect of the present invention, a water level/vibration sensing apparatus includes a housing provided with an air inlet, a bellows expanded and contracted according to an air pressure transmitted through the air inlet, a diaphragm unit connected to the bellows to move forward and backward according to the expansion and contraction of the bellows, and provided with a support shaft, a core installed on the support shaft, a bobbin installed in the housing such that the core is movable within the bobbin, a coil provided on the outer circumferential surface of the bobbin, elastic members to respectively support both ends of the diaphragm unit, and a collision member provided in a pressure chamber formed between the air inlet and the bellows to strike the diaphragm unit according to the movement of the housing.

A reception part, one end of which is opened to receive the collision member, may be formed in the pressure chamber, and the air inlet may be provided in the reception part.

The collision member may be a ball member made of a rustproof metal.

A rib to prevent the air inlet from being closed with the ball member may be provided around the air inlet.

A tilt plane may be formed on the inner surface of the reception part such that the ball member strikes the diaphragm unit when the vibration of the ball member is a designated level or more.

A restricting protrusion may be formed on the tilt plane.

The elastic members may have the same modulus of elasticity.

In accordance with a further aspect of the present invention, a washing machine includes a tub, a spin basket rotatably connected to the inside of the tub, a water level/vibration sensing apparatus installed at one side of the tub to sense the water level in the tub and the vibration of the spin basket, and an air hose provided with one end communicating with the tub and the other end communicating the water level/vibration sensing apparatus, the water level/vibration sensing apparatus including a housing provided with an air inlet communicating with the air hose, a diaphragm unit moving forward and backward according to a pressure supplied through the air hose, a core and a coil forming a frequency varied according to the forward and backward movement of the diaphragm unit, and a collision member striking the diaphragm unit according to the vibration of the tub.

The water level/vibration sensing apparatus may further include a bellows expanded and contracted, and sealed such that an air pressure supplied through the air inlet does not leak, and the diaphragm unit may be connected to the bellows.

A pressure chamber formed by the bellows may be provided in the housing, and the collision member is provided in the pressure chamber.

A reception part, one end of which is opened to receive the collision member, may be formed in the pressure chamber.

The air inlet may be provided in the reception part.

The collision member may include a ball member.

A tilt plane tilted at a designated angle may be formed on the reception part.

A restricting protrusion may be formed on the tilt plane.

A rib protruding from the inner surface of the housing may be provided around the air inlet.

The water level/vibration sensing apparatus may further include elastic members respectively supporting both ends of the diaphragm unit and having the same modulus of elasticity.

The collision member may include a ball member, and a tension spring elastically supporting the ball member.

One end of the tension spring may be fixed to one end of the inner surface of the housing, the other end of the tension spring may be fixed to the ball member, and the ball member may be separated from the diaphragm unit by a designated interval.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
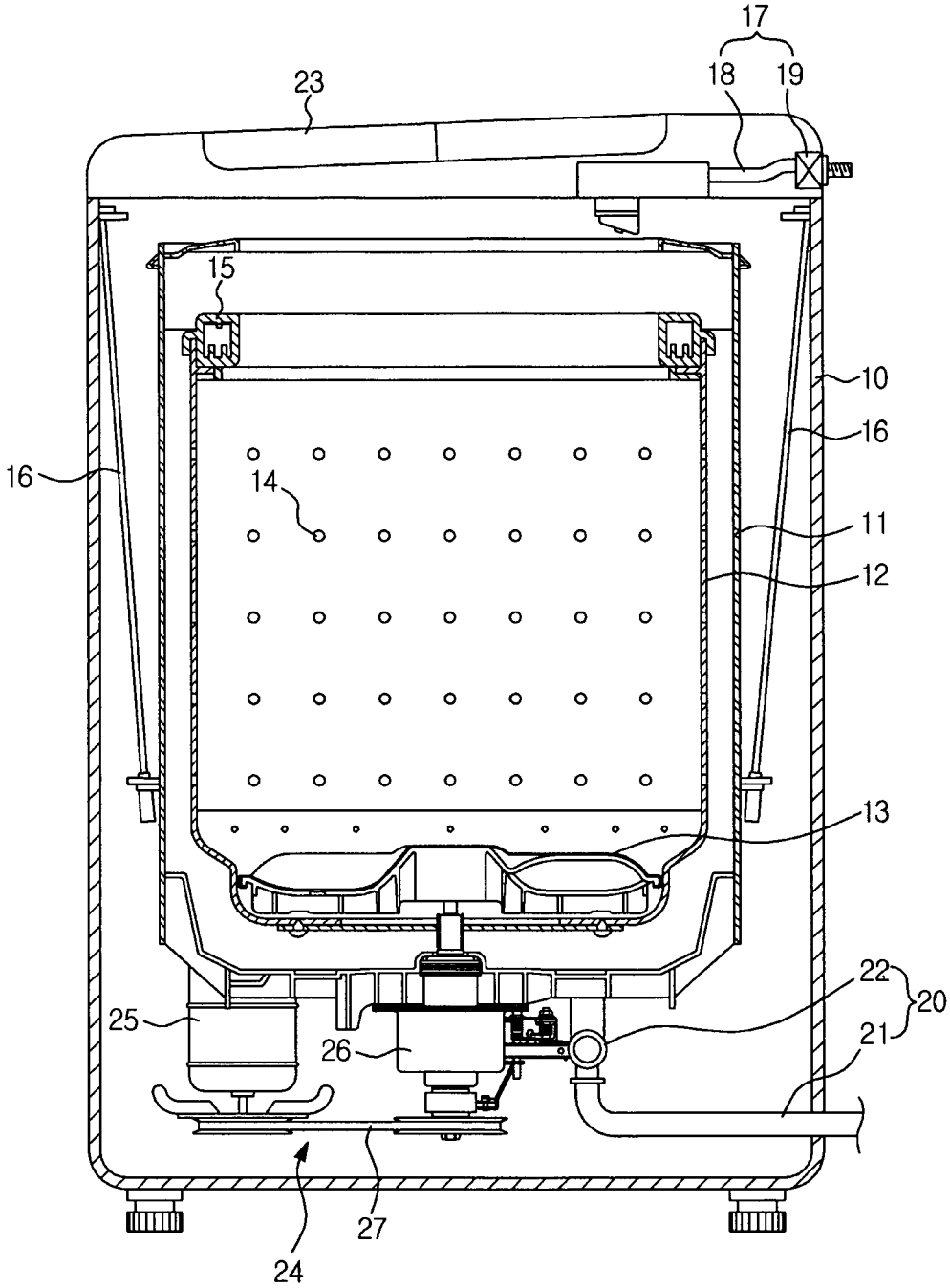
FIG. 1 illustrates a longitudinal-sectional view of a washing machine in accordance with an exemplary embodiment.

Reference will now be made in detail to the embodiments of the present invention, examples of which are illustrated in the accompanying drawings, wherein like reference numerals refer to the like elements throughout.

Figure 2:
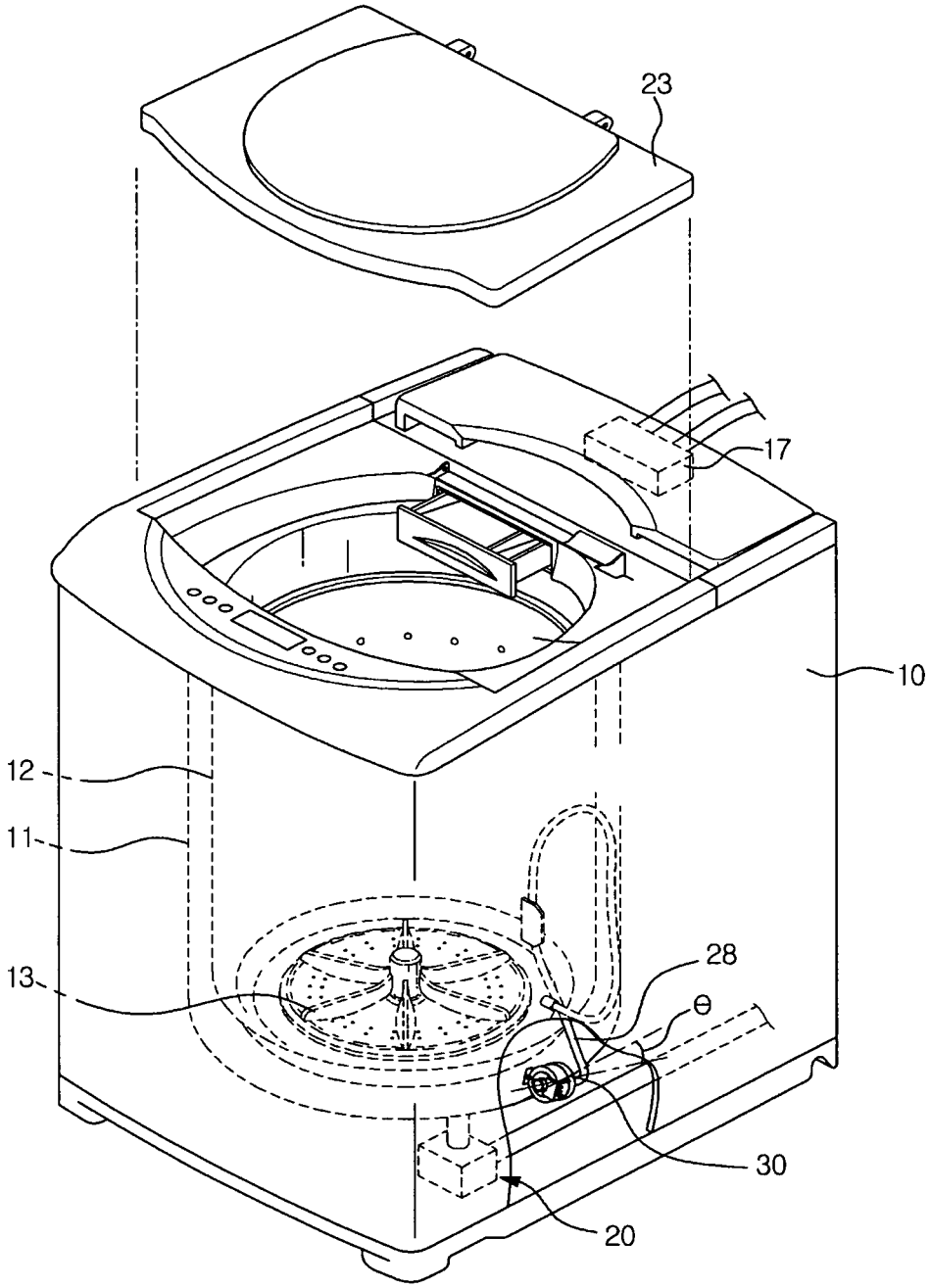
FIG. 2 illustrates a perspective view of the washing machine in accordance with an exemplary embodiment in a state in which a water level/vibration sensing apparatus is installed in the washing machine.

FIG. 1 is a longitudinal-sectional view schematically illustrating a washing machine in accordance with one embodiment of the present invention, and FIG. 2 is a perspective view illustrating the washing machine in accordance with the embodiment of the present invention in a state in which a water level/vibration sensing apparatus is installed in the washing machine.

With reference to FIGS. 1 and 2, the washing machine in accordance with one embodiment of the present invention includes a tub 11 installed in a main body 10 to contain washing water, a spin basket 12 rotatably installed in the tub 11, and a pulsator 13 installed in the spin basket 12 to agitate the washing water and laundry.

The tub 11 is supported by suspension devices 16 under the condition that the lower part of the outer surface of the tub 11 is connected to the suspension devices 16 hung onto the upper end of the inside of the main body 10. A water supply device 17 including a water supply pipe 18 and a water supply valve 19 to supply the washing water to the inside of the tub 11 is provided above the tub 11. A drain device 20 including a drain pipe 21, a drain valve 22, and a drain motor (not shown) to discharge the washing water filling the tub 11 to the outside of the washing machine is provided below the tub 11.

The spin basket 12 is formed in a cylindrical shape, the upper surface of which is opened, and a plurality of dehydration holes 14 is formed through the circumferential surface of the spin basket 12. A general balancer 15 to allow the spin basket 12 to stably rotate when the spin basket 12 is rotated at a high speed is installed on the upper part of the spin basket 12.

A door 23 to open and close the opened upper surface of the spin basket 12 is provided on the upper surface of the main body 10, and the pulsator 13 to form a current of the washing water is rotatably installed on the bottom surface of the spin basket 12.

The washing machine further includes a driving device 24 to rotate the pulsator 13. The driving device 24 in accordance with this embodiment includes a motor 25 installed under one side of the tub 11, a power transmission device 26 to selectively transmit the rotary force of the motor 25 to the spin basket 12 and the pulsator 13, and a belt 27 serving as a medium to transmit power between the motor 25 and the power transmission device 26.

The power transmission device 26 is provided with a general clutch device, which receives the power of the motor 25, and rotates the pulsator 13 at a reduced speed or rotates the spin basket 12.

Although this embodiment of the present invention exemplarily illustrates that the driving device to rotate the pulsator applies the power transmission device provided with the clutch device, a direct connection type driving device, in which a pulsator is directly rotated by a motor, may be used.

As shown in FIG. 2, a water level/vibration sensing apparatus 30, which senses the washing water level in the tub 11 or senses the vibration caused by the eccentric rotation of the spin basket 12 due to the partial disposition of laundry, is provided on the lower part of the outer surface of the tub 11.

The water level/vibration sensing apparatus 30 is connected to one end of an air hose 28, filled with air, the other end of which communicates with the tub 11.

The water level/vibration sensing apparatus 30 includes a water level sensor, which receives an air pressure, varied according to the filling of the tub 11 with water, through the air hose 28, and measures the variation of a frequency thereby to sense the water level in the tub 11.

Figure 3:
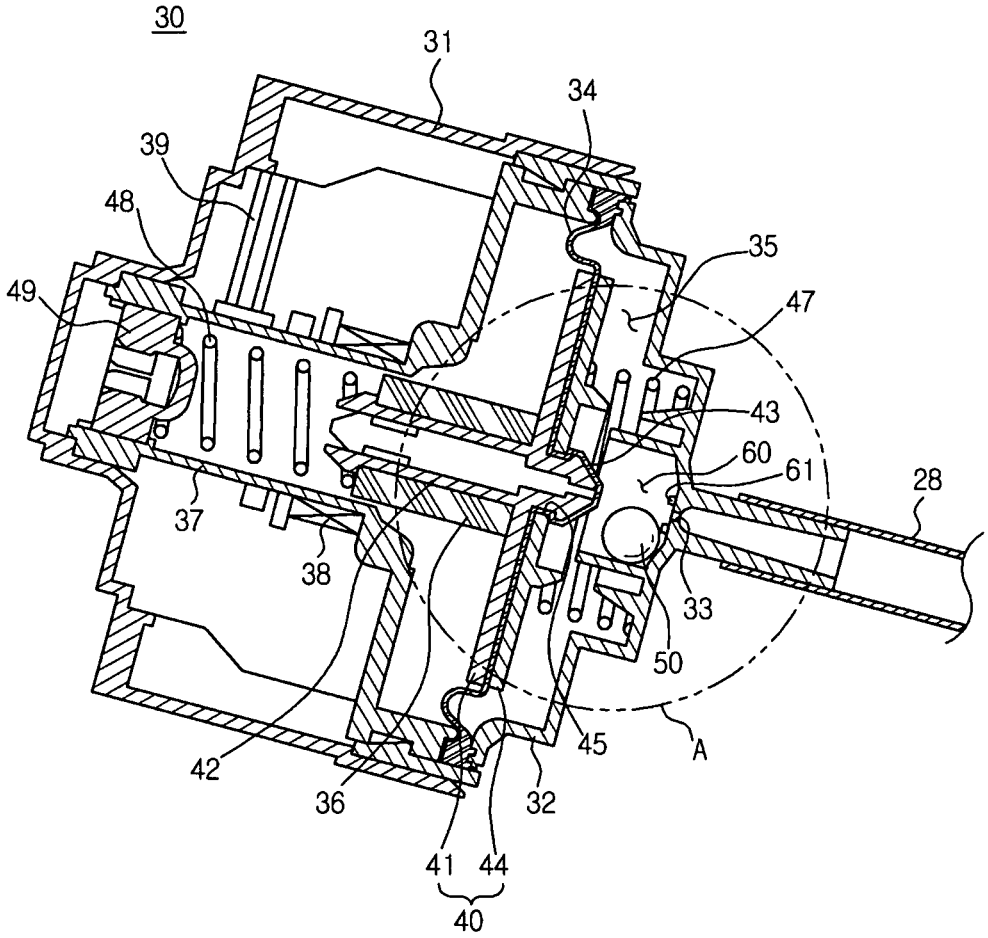
FIG. 3 illustrates a longitudinal-sectional view of the water level/vibration sensing apparatus of the washing machine in accordance with an exemplary embodiment.

FIG. 3 is a longitudinal-sectional view of the water level/vibration sensing apparatus of the washing machine in accordance with this embodiment of the present invention. As shown in FIG. 3, the water level/vibration sensing apparatus 30 includes a housing 31 having a cylindrical shape, one end of which is opened, and a housing cover 32 to seal the opened end of the housing 31.

An air inlet 33, through which the air transmitted through the air hose 28 is supplied to the inside of the housing 30, is formed through the front surface of the housing cover 32, and a bellows 34, which is expanded and contracted according to the air pressure transmitted through the air hose 28, is installed at the connection part between the housing cover 32 and the housing 31.

The bellows 34 is sealed such that the air pressure flowing in through the air inlet 33 does not leak, and thereby a pressure chamber 35 is formed between the air inlet 33 and the bellows 34.

A diaphragm unit 40, which ascends and descends in the housing 31 according to the expansion and contraction of the bellows 34, is installed at the center of the bellows 34.

The diaphragm unit 40 includes an upper diaphragm 41 provided with a hook part 43, and a lower diaphragm 44 provided with a hook connection hole 45. The upper diaphragm 41 and the lower diaphragm 44 are respectively connected to the upper and lower surfaces of the bellows 34 by hook connection.

Both ends of the diaphragm unit 40 are elastically supported by elastic members 46. The elastic members 46 include a first elastic member 47 provided between the housing cover 32 and the lower diaphragm unit 40, and a second elastic member 48 provided between the housing 31 and the upper diaphragm 41.

The first and second elastic members 47 and 48 have the same modulus of elasticity to have linear characteristics when the diaphragm unit 40 moves by the pressure.

These elastic members 46 may be coil springs made of a nonmagnetic material, such as rubber or resin.

A cylindrical support shaft 42 is provided at the center of the upper diaphragm 41, and a core 36 is installed on the outer circumferential surface of the support shaft 42. Further, a bobbin 37, in which the core 36 is movable according to the variation of the pressure, is formed at the central portion of the inside of the housing 31 in parallel with the moving direction of the core 36.

A coil 38, which forms a resonance circuit together with a separate condenser (not shown), is provided on the outer circumferential surface of the bobbin 37, and a terminal 39, to which a cable connected to a control unit (not shown) is connected, is installed at a portion of the bobbin 37 located above the coil 38.

The upper portion of the bobbin 37 is connected to the inside of the housing 31 through a connection bolt 49, and both ends of the second elastic member 48 in the bobbin 37 are respectively supported by the connection bolt 49 and the support shaft 42.

Thereby, the inductance of the coil 38 is varied according to the forward and backward movement of the core 36 in the bobbin 37, and the frequency of the resonance circuit including the coil 38 and the condenser (not shown) is varied according to the variation of the inductance. Therefore, the water level of the washing machine is measured from this variation of the output frequency.

The water level/vibration sensing apparatus 30 in accordance with one embodiment of the present invention further includes a vibration sensing unit, which senses the unbalance of the spin basket 12 generated due to the partial disposition of laundry.

On this account, a collision member 50, which strikes the diaphragm unit 40 to sense variation according to the eccentric rotation of the spin basket 12, is provided in front of the diaphragm unit 40.

The collision member 50 in accordance with this embodiment may be a ball member. The ball member may be made of a rustproof metal, such as stainless steel or aluminum.

Further, a cylindrical reception part 60 to receive the collision member 50 is provided at the inside of the housing cover 32. One end surface of the reception part 60 is opened to communicate with the pressure chamber 35, and the diaphragm unit 40 is disposed close to the opened end surface of the reception part 60.

Although the reception part 60 may be located at a position, where the collusion member 50 strikes the diaphragm unit 40, the reception part 60 may be formed at the center of the Inside of the housing cover 32 such that the collision member 50 strikes the central portion of the diaphragm unit 40.

Figure 4:
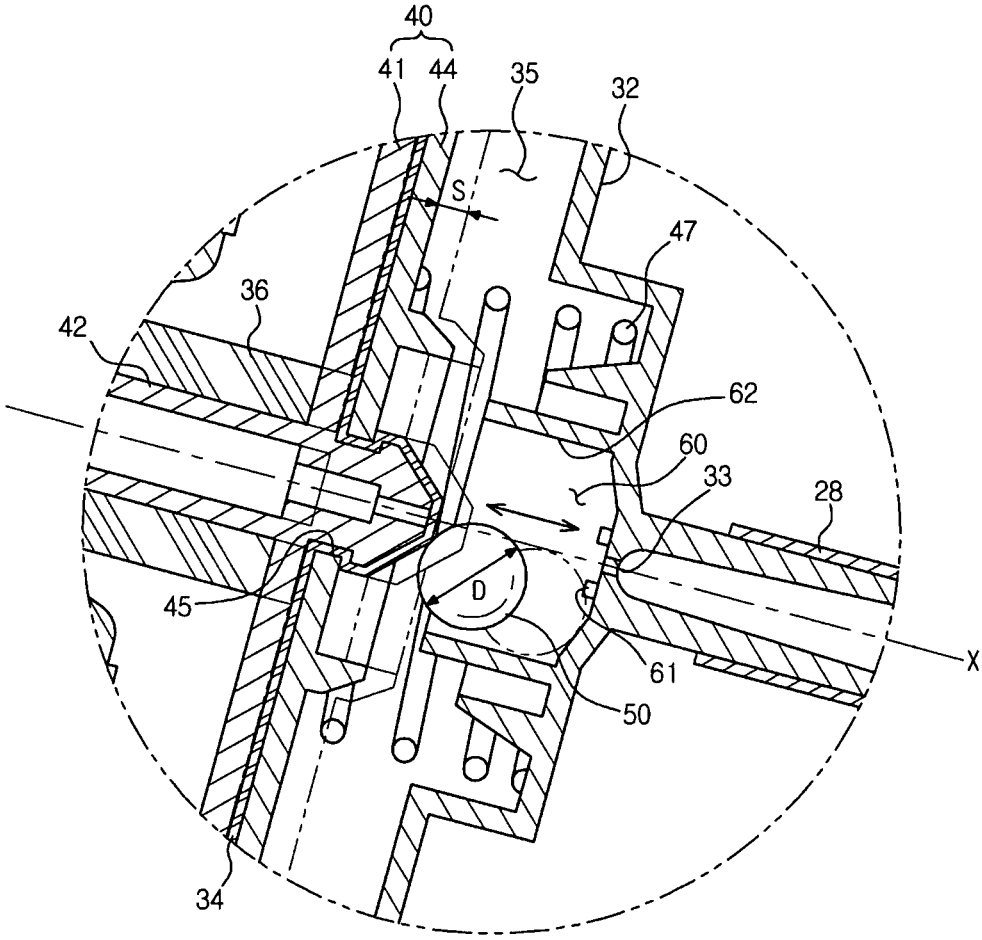
FIG. 4 illustrates an enlarged view of the portion 'A' of FIG. 3.

With reference to FIG. 4, if the reception part 60 is formed at the center of the inside of the housing cover 32, the air inlet 33, through which the air pressure transmitted through the air hose 28 flows into the housing 31, is formed in the reception part 60. In this case, in order to prevent the air inlet 33 from being closed with the collision member 50, a rib 61 protruding from the inner surface of the housing cover 32 in a radial shape is provided around the air inlet 33.

On the other hand, when the collision member 50 is a ball member, the collision member 50 has a diameter D, which is larger than the moving distance S of the diaphragm unit 40, to prevent the collision member 50 from being separated from the reception part 60 through the opened surface of the reception part 60 after the collision member 50 has struck the diaphragm unit 40.

Further, if an inner wall 62 forming the reception part 60 is perpendicular to the diaphragm unit 40, when the water level/vibration sensing device 30 is installed parallel with the tub 11 in the X-axis direction, the collision member 50 strikes the diaphragm unit 40 even if any vibration is generated. Therefore, in order to prevent this problem, the water level/vibration sensing device 30 is installed at a designated tile angle θ relative to the tub 11 (with reference to FIG. 2).

Figure 5:
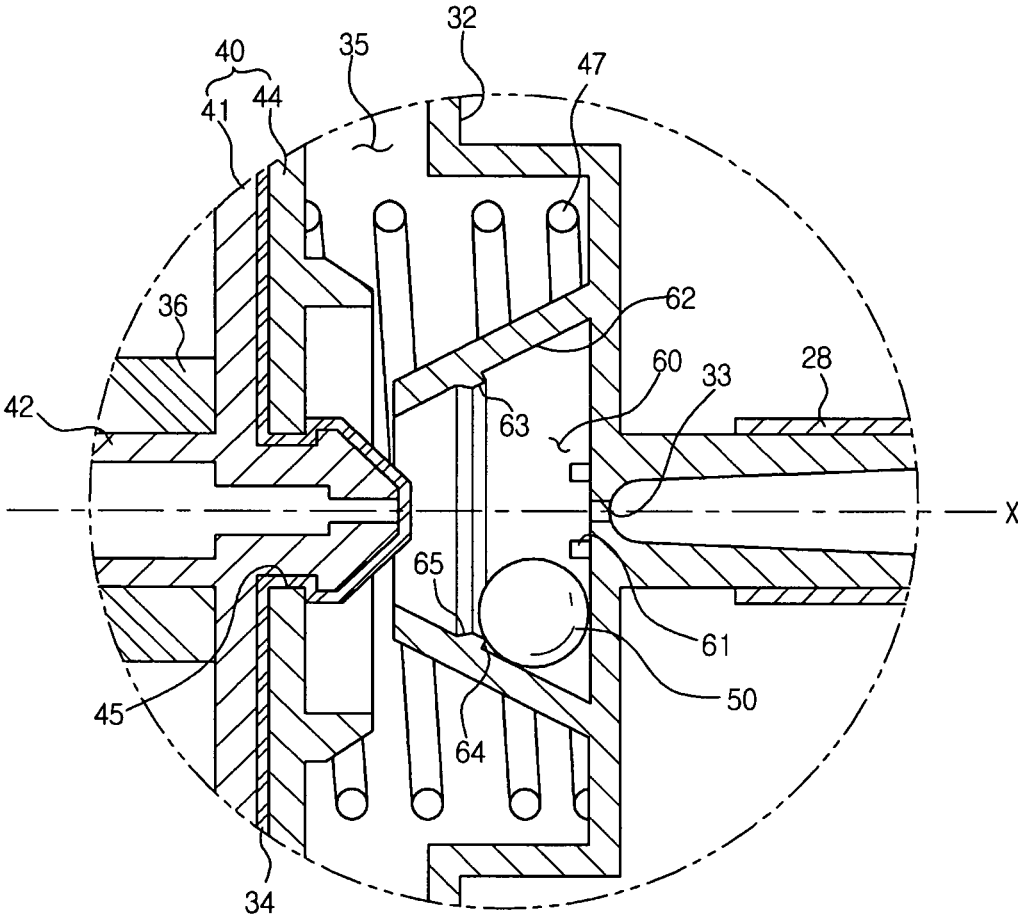
FIG. 5 illustrates an enlarged view of the portion 'A' of FIG. 3 according to another exemplary embodiment.

FIG. 5 illustrates a reception part in accordance with another embodiment of the present invention. Hereinafter, elements in this embodiment, functions of which are substantially same as those in the former embodiment, are denoted by the same reference numerals even if they are depicted in different drawings, and a detailed description thereof will thus be omitted because it is, considered to be unnecessary.

As shown in FIG. 5, the inner wall 62 of the reception part 60 is tilted toward the inside of the reception part 60 at a designated angle. That is, the reception part 60 has a cylindrical shape with a trapezoidal section, in which the diameter is narrowed from the lower portion of the reception part 60 to the upper portion of the reception part 60.

Through the above configuration, when the water level/vibration sensing device 30 is installed parallel with the tub 11 in the X-axis direction, the collision member 50 is located at the lower portion of the reception part 60 at all times, and thus in order to strike the diaphragm unit 40, vibration of a designated level or more to be applied to the collision member 50 is required.

Although the embodiment of FIG. 5 illustrates that the inner wall 62 of the reception part 60 is tilted, a tilt guide part having a tilt plane at a designated angle may be formed on the inner wall 62 of the cylindrical reception part 60 of FIG. 4.

Further, a restricting protrusion 63 may be formed at a designated portion of the tilted inner wall 62 of the reception part 60 such that the collision member 50 strikes the diaphragm unit 40 only when vibration of a designated level or more is applied to the collision member 50.

The restricting protrusion 63 may have various shapes and sizes such that the collision member 50 passes through the protrusion 63 and strikes the diaphragm unit 40 according to the level of the vibration. In this embodiment, the restricting protrusion 63 includes a restriction part 64 to restrict the movement of the collision member 50 below the designated level of the vibration, and a tilt part 65 to facilitate the return of the collision member 50 to an original position thereof after the collision member 50 has struck the diaphragm unit 40.

When the water level/vibration sensing device 30 having the reception part 60 with the tilt structure of the inner wall 62 is installed on the tub 11, the water level/vibration sensing device 30 precisely senses the unbalance of the spin basket 12 even if the water level/vibration sensing device 30 is not installed at the designated tilt angle θ (with reference to FIG. 2).

Figure 6:
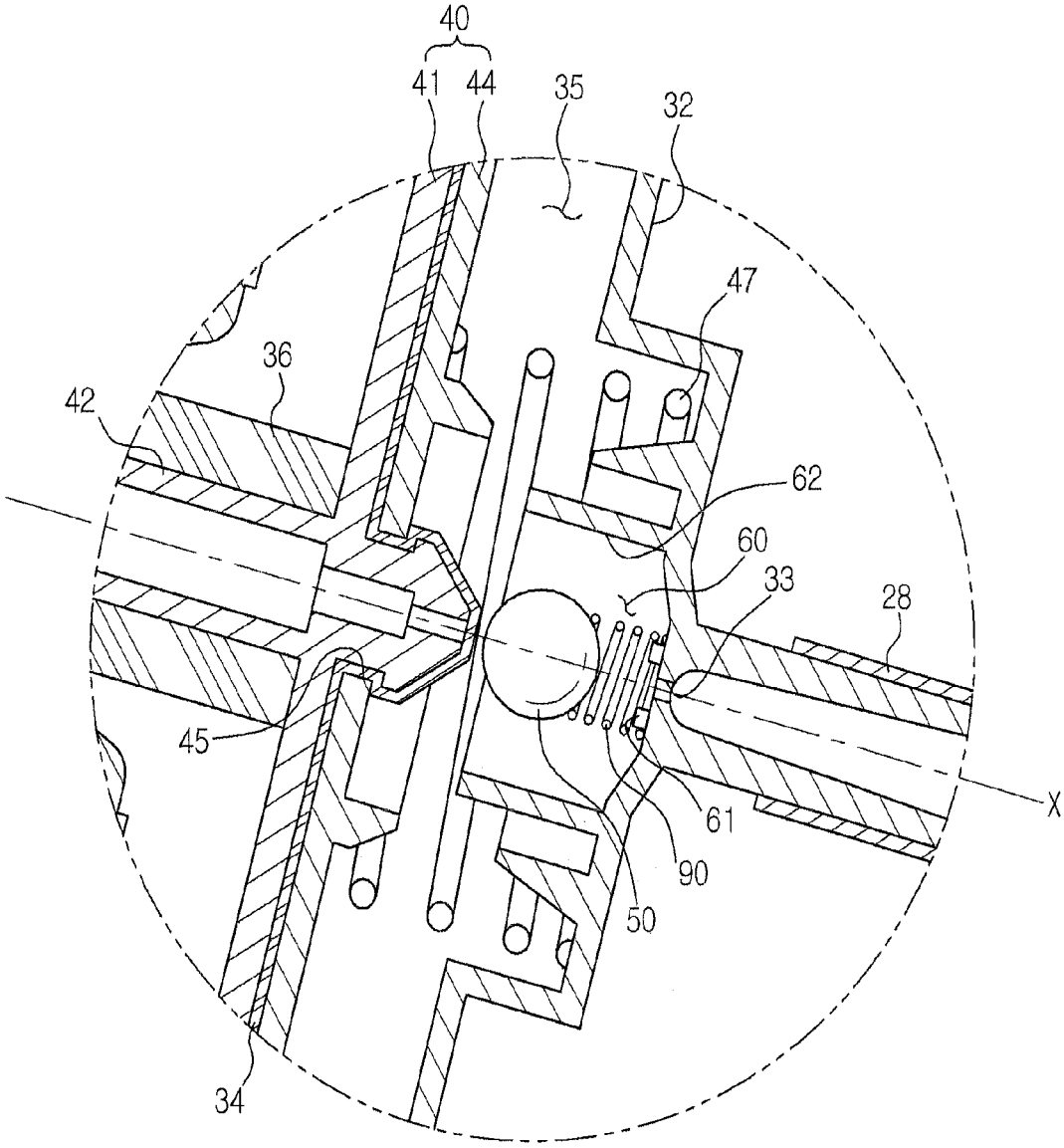
FIG. 6 illustrates an enlarged view of the portion 'A' of FIG. 3 including an exemplary tension spring.

As illustrated in FIG. 6, a collision member 50 may be a ball member connected to one end of a tension spring 90. That is, one end of the tension spring 90 is connected to the housing cover 32, and the other end of the tension spring, to which the ball member is connected, is provided in the pressure chamber 35. Thereby, when external force exceeding the elastic force of the tension spring is applied, the ball member strikes the diaphragm unit.

Hereinafter, with reference to FIGS. 1 to 5, the operation and effects of a water level/vibration sensing apparatus in accordance with one embodiment of the present invention will be described.

First, the water level sensing operation of the water level/vibration sensing apparatus 30 of the present invention will be described.

In the washing course and the rinsing course of the washing machine, the water supply device 17 is operated, and thus supplies washing water to the inside of the tub 11.

The washing water level in the tub 11 is raised according to the progress of the supply of the washing water, and the pressure of the washing water is transmitted to the air inlet 33 through the air hose 28.

The air pressure transmitted from the air inlet 33 increases the pressure in the pressure chamber 35 at the inside of the bellows 34, and thereby the bellows 34 are expanded.

The diaphragm unit 40 ascends according to the expansion of the bellows 34, and the core 36 connected to the diaphragm unit 40 moves to the internal space of the coil 38 according to the ascent of the diaphragm unit 40.

The inductance of the coil 38 is varied according to the movement of the core 36, and the capacitance of the condenser (not shown) is multiplied by the varied inductance and thus forms a frequency.

Therefore, the control unit (not shown) compares the measured frequency value with a water level frequency value, which is predetermined according to, the amount of laundry, and thus controls whether or not the washing water is continuously supplied.

In this case, the collision member 50 provided in the reception part 60 exerts no action during the water level sensing operation of the water level/vibration sensing apparatus 30.

Next, the vibration sensing operation of the water level/vibration sensing apparatus 30 of the present invention will be described.

In the dehydrating course of the washing machine, when the drain of the washing water in the tub 11 has been completed, the pressure in the pressure chamber 35 is lowered and the diaphragm unit 40 is returned to an original position thereof by the elastic members 46.

When the laundry is uniformly disposed in the spin basket 12 during the dehydrating course, the water level/vibration sensing apparatus 30 attached to the tub 11 is rotated in a concentric circle on the shaft of the spin basket 12, and thus the spin basket 12 maintains a balanced state.

However, when the laundry is partially disposed at one side of the spin basket 12, the spin basket 12 is eccentrically rotated, and an unbalanced state in which the spin basket 12 strikes the tub 11, is generated when the eccentricity of the spin basket 12 increases.

When the unbalance of the spin basket 12 is generated, an impact is applied also to the water level/vibration sensing apparatus 30 connected to one side of the tub 11.

When the impact is applied to the water level/vibration sensing apparatus 30, the collision member 50 provided in the reception part 60 moves and strikes the diaphragm unit 40.

The diaphragm unit 40, on which the core 36 is installed, ascends according to the striking by the collision member 50, and the inductance of the coil 38 is varied according to the movement of the core 36 and thus an output frequency value is varied.

Therefore, it may be possible to sense the unbalance of the washing machine from the variation of the output frequency.

Further, the collision amount of the collision member 50 striking the diaphragm unit 40 is varied according to the level of the vibration of the tub 11, and the movement range of the diaphragm unit 40 is varied according to the variation of the collision amount. Therefore, it may be possible to determine various variation states.

Thereby, the water level/vibration sensing apparatus 30 of the present invention may sense a walking state generated during the dehydrating course.

That is, the walking state is a state in which vibration is generated by the partial disposition of laundry during the dehydrating course, and thus the main body 10 moves due to the progress of the dehydration of the laundry under the condition that the vibration is maintained.

In such a walking state, the collision between the main body 10 and the tub 11 is not generated. However, in the walking state, the collision member 50 provided in the reception part 60 of the water level/vibration sensing apparatus 30 is moved by the amplitude of the vibration generated right and left or front and rear due to the movement of the main body 10, and strikes the diaphragm unit 40, thus varying an output frequency.

In this case, the collision member 50 continuously strikes the diaphragm unit 40, and thus the frequency is continuously varied. Therefore it may be possible to sense whether or not the main body 10 is in the walking state.

Therefore, the water level/vibration sensing apparatus 30 in accordance with one embodiment of the present invention simultaneously may sense the walking state of the main body 10 and the unbalanced state of the spin basket 12.

Further, since the collision member 50 strikes the diaphragm unit 40 only when the vibration of the collision member 50 provided in the reception part 60 reaches a designated level or more, the water level/vibration sensing apparatus 30 precisely senses whether or not the washing machine malfunctions according to respective vibration states.

Moreover, the water level/vibration sensing apparatus 30 in accordance with one embodiment of the present invention senses whether or not vibration is generated only using the collision member 50 striking the diaphragm unit 40, and thus has a simple structure and improves productivity.

As is apparent from the above description, the water level/vibration sensing apparatus in accordance with one embodiment of the present invention and the washing machine having the same simultaneously sense various types of vibration and a water level through a simple structure, thus being capable of improving productivity and precisely sensing whether or not the washing machine malfunctions.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A water level/vibration sensing apparatus comprising:

a housing provided with a pressure chamber communicating with an air inlet;

a diaphragm unit moving forward and backward according to a pressure variation in the pressure chamber;

a core connected to the diaphragm unit and a resonance circuit including a coil, wherein a frequency of the resonance circuit being varied according to the forward and backward movement of the diaphragm unit; and a collision member striking the diaphragm unit and moving the diaphragm unit according to a movement of the housing and varying an inductance of the coil, wherein a water level/vibration being sensed based on a variation in the inductance.

2. The water level/vibration sensing apparatus according to claim 1, wherein a reception part is formed in the pressure chamber, one end of which is opened to receive the collision member.

3. The water level/vibration sensing apparatus according to claim 2, wherein the reception part has a cylindrical shape.

4. The water level/vibration sensing apparatus according to claim 3, further comprising a restricting protrusion formed at a designated region of an inner wall of the reception part.

5. The water level/vibration sensing apparatus according to claim 4, wherein the restricting protrusion includes a restriction part to restrict a movement of the collision member, and a tilt part to facilitate a return of the collision member to an original position thereof after the movement of the collision member.

6. The water level/vibration sensing apparatus according to claim 3, wherein the reception part includes an inner wall tilted at a designated angle.

7. The water level/vibration sensing apparatus according to claim 3, further comprising a tilt plane being formed on the reception part.

8. The water level/vibration sensing apparatus according to claim 2, wherein the air inlet is formed within the reception part.

9. The water level/vibration sensing apparatus according to claim 8, further comprising a rib preventing the air inlet from being closed by the collision member, the rib being provided around the air inlet.

10. The water level/vibration sensing apparatus according to claim 1, wherein the collision member is made of a rustproof metal.

11. A water level/vibration sensing apparatus comprising:

a housing provided with an air inlet;

a bellows expanding and contracting according to an air pressure transmitted through the air inlet;

a diaphragm unit connected to the bellows to move forward and backward according to the expansion and contraction of the bellows, and including a support shaft;

a core installed on the support shaft of the diaphragm unit;

a bobbin installed in the housing allowing the core to be movable within the bobbin;

a coil provided on an outer circumferential surface of the bobbin;

elastic members respectively supporting both ends of the diaphragm unit; and a collision member provided in a pressure chamber formed between the air inlet and the bellows to strike the diaphragm unit and to move the diaphragm unit according to a movement of the housing and varying inductance of the coil, wherein a water level/vibration being sensed based on a variation in the inductance.

12. The water level/vibration sensing apparatus according to claim 11, wherein pressure from washing water is transmitted to the air pressure transmitted through the air inlet.

13. The water level/vibration sensing apparatus according to claim 11, wherein the core moves through an internal space of the coil.

14. The water/vibration sensing apparatus according to claim 11, wherein a level of water is sensed from a frequency of a resonance circuit from movement of the core through an internal space of the coil.

15. The water/vibration sensing apparatus according to claim 11, wherein the collision member is motionless while water is being supplied.

16. The water level/vibration sensing apparatus according to claim 11, wherein a reception part being formed in the pressure chamber, one end of which is opened to receive the collision member, the air inlet being provided in the reception part.

17. The water level/vibration sensing apparatus according to claim 16, wherein the collision member is a ball member made of a rustproof metal.

18. The water level/vibration sensing apparatus according to claim 17, further comprising a rib preventing the air inlet from being closed by the ball member, the rib being provided around the air inlet.

19. The water level/vibration sensing apparatus according to claim 18, further comprising a tilt plane formed on an inner surface of the reception part such that the ball member strikes the diaphragm unit when an amount of vibration of the ball member is at a designated level or higher.

20. The water level/vibration sensing apparatus according to claim 19, wherein a restricting protrusion is formed on the tilt plane.

21. The water level/vibration sensing apparatus according to claim 11, wherein the elastic members have a same modulus of elasticity.

22. The water/vibration sensing apparatus according to claim 11, wherein a level of vibration is sensed from the collision member striking the diaphragm unit.

23. The water/vibration sensing apparatus according to claim 11, wherein the diaphragm unit moves according to striking by the collision member.

24. A washing machine, including a tub, a spin basket rotatably connected to an inside of the tub, a water level/vibration sensing apparatus installed at one side of the tub to sense a water level in the tub and a vibration of the spin basket, and an air hose provided with one end communicating with the tub and another end communicating with the water level/vibration sensing apparatus, the water level/vibration sensing apparatus comprising:

a housing provided with an air inlet communicating with the air hose;

a diaphragm unit moving forward and backward according to a pressure supplied through the air hose;

a core connected to the diaphragm unit and a resonance circuit including a coil, a frequency of the resonance circuit being varied according to the forward and backward movement of the diaphragm unit; and a collision member striking the diaphragm unit and moving the diaphragm unit according to a vibration of the tub and varying inductance of the coil, wherein a water level/vibration being sensed based on a variation in the inductance.

25. The washing machine according to claim 24, wherein the washing machine uses the water level/vibration sensing apparatus to both sense a water level and a vibration level of the tub.

26. The washing machine according to claim 24, wherein the water level/vibration sensing apparatus further comprises a bellows which expands and contracts, and is sealed such that an air pressure supplied through the air inlet does not leak, and the diaphragm unit is connected to the bellows.

27. The washing machine according to claim 26, wherein a pressure chamber formed by the bellows is provided in the housing, and the collision member is provided in the pressure chamber.

28. The washing machine according to claim 27, wherein a reception part, formed in the pressure chamber, includes an end which is opened to receive the collision member.

29. The washing machine according to claim 28, wherein the air inlet is provided in the reception part.

30. The washing machine according to claim 29, wherein the collision member includes a ball member.

31. The washing machine according to claim 30, wherein a tilt plane tilted at a designated angle is formed on the reception part.

32. The washing machine according to claim 31, wherein a restricting protrusion is formed on the tilt plane.

33. The washing machine according to claim 31, wherein a rib protruding from an inner surface of the housing is provided around the air inlet.

34. The washing machine according to claim 24, wherein the water level/vibration sensing apparatus further comprises elastic members respectively supporting both ends of the diaphragm unit and having a same modulus of elasticity.

35. A washing machine including a tub, a spin basket rotatably connected to an inside of the tub, a water level/vibration sensing apparatus installed at one side of the tub to sense a water level in the tub and a vibration of the spin basket, and an air hose provided with one end communicating with the tub and another end communicating with the water level/vibration sensing apparatus, the water level/vibration sensing apparatus comprising:

a housing provided with an air inlet communicating with the air hose;

a diaphragm unit moving forward and backward according to a pressure supplied through the air hose;

a core, and a resonance circuit including a coil, a frequency of the resonance circuit being varied according to the forward and backward movement of the diaphragm unit; and a collision member striking the diaphragm unit and moving the diaphragm unit according to a vibration of the tub, wherein the water level/vibration sensing apparatus further comprises a bellows which expands and contracts, and is sealed such that an air pressure supplied through the air inlet does not leak, and the diaphragm unit is connected to the bellows, wherein a pressure chamber formed by the bellows is provided in the housing, and the collision member is provided in the pressure chamber, wherein the collision member includes a ball member, and a tension spring elastically supporting the ball member.

36. The washing machine according to claim 35, wherein one end of the tension spring is fixed to one end of an inner surface of the housing, another end of the tension spring is fixed to the ball member, and the ball member is separated from the diaphragm unit by a designated interval.

* * * * *

UNITED STATES PATENT AND TRADEMARK OFFICE

CERTIFICATE OF CORRECTION

PATENT NO. : 8,701,449 B2
APPLICATION NO. : 12/654199
DATED : April 22, 2014
INVENTOR(S) : Dong Il Back et al.

It is certified that error appears in the above-identified patent and that said Letters Patent is hereby corrected as shown below:

In the Claims

Column 10, Line 12, In Claim 14, Delete "water/vibration" and insert -- water level/vibration --, therefor.

Column 10, Line 16, In Claim 15, Delete "water/vibration" and insert -- water level/vibration --, therefor.

Column 10, Line 42, In Claim 22, Delete "water/vibration" and insert -- water level/vibration --, therefor.

Column 10, Line 45, In Claim 23, Delete "water/vibration" and insert -- water level/vibration --, therefor.

Signed and Sealed this
Twenty-third Day of December, 2014

Michelle K. Lee

Michelle K. Lee
*Deputy Director of the United States Patent and Trademark Office*